US007128643B2

(12) United States Patent
Beliveau et al.

(10) Patent No.: US 7,128,643 B2
(45) Date of Patent: Oct. 31, 2006

(54) REMOVABLE VENT HAVING A FILTER FOR USE IN A BUILDING FOUNDATION

(75) Inventors: John A. Beliveau, Mooresville, NC (US); Frank V. Buonaiuto, Sr., New Milford, CT (US); Anthony B. Buonaiuto, Danbury, CT (US)

(73) Assignee: ACI Air Technologies, LLC, Mooresville, NC (US)

( * ) Notice: Subject to any disclaimer, the term of this patent is extended or adjusted under 35 U.S.C. 154(b) by 0 days.

(21) Appl. No.: 10/858,594

(22) Filed: Jun. 1, 2004

(65) Prior Publication Data

US 2005/0266791 A1 Dec. 1, 2005

(51) Int. Cl.
*F24F 13/28* (2006.01)

(52) U.S. Cl. ..... 454/276; 454/271; 55/506

(58) Field of Classification Search ..... 454/271, 454/272, 273, 274, 276; 55/385.2, 506
See application file for complete search history.

(56) References Cited

U.S. PATENT DOCUMENTS 2,818,793 A * 1/1958 Hord ..... 454/203
3,192,849 A * 7/1965 Massengale ..... 454/276
3,986,850 A 10/1976 Wilcox
3,999,969 A 12/1976 Shuler
4,274,330 A * 6/1981 Witten et al. ..... 454/276
4,587,892 A * 5/1986 Witten et al. ..... 454/276
4,669,371 A * 6/1987 Sarazen et al. ..... 454/276
4,724,749 A 2/1988 Hedrick
5,176,570 A 1/1993 Liedl
5,525,145 A 6/1996 Hodge
5,976,007 A * 11/1999 Powell et al. ..... 454/48
6,302,785 B1 10/2001 McKinney et al.
6,361,578 B1 3/2002 Rubinson
6,371,846 B1 * 4/2002 Powell et al. ..... 454/271
6,468,054 B1 10/2002 Anthony et al.
6,604,994 B1 * 8/2003 Achen ..... 454/271
6,817,942 B1 * 11/2004 Betz ..... 454/271

FOREIGN PATENT DOCUMENTS

GB 506197 * 1/1930 ..... 454/271

* cited by examiner

*Primary Examiner*—Gregory Wilson

(57) ABSTRACT

A removable ventilator is equipped to hold an air filter, the ventilator being designed for placement in a building foundation, for example between concrete blocks. The front of the ventilator faces away from the building when the ventilator is installed. The rear of the ventilator faces into the building when the ventilator is installed. At least one securing device is located at the rear of the ventilator, for securing the air filter to the rear. At least one manual handling feature is located at the front of the ventilator, for removing the ventilator from between the concrete blocks.

14 Claims, 9 Drawing Sheets

REMOVABLE VENT HAVING A FILTER FOR USE IN A BUILDING FOUNDATION

TECHNICAL FIELD

The present invention relates to spaces beneath buildings, and more particularly to ventilation for those spaces.

BACKGROUND OF THE INVENTION

Ventilators for basements and crawlspaces are known in the art, including ventilators that are held in place by spring clips. See, for example, Sarazen (U.S. Pat. No. 4,669,371). However, such ventilating units do not eliminate the problem of mold and other organic growth in the crawlspace, and in fact can exacerbate the problem by allowing access of such organic material into the crawlspace.

Rain, humidity, mold, and pollen often find their way into existing ventilators, and thence into the basement or crawlspace. If one of the existing ventilators were to be equipped with a filter, the filter would be subject to moisture, making it soggy, and in fact creating a potential breeding place for mold, and the filter would not be easily replaced, and may require professional replacement using tools of the trade.

Moisture gets into crawlspaces many other ways than through ventilators. For example, ground water typically evaporates into a crawlspace, as much as ten gallons daily for every 700 square feet of dirt. Additionally, brick and concrete foundation walls commonly absorb and transmit outside moisture to the interior space.

Mold spores and pollen thrive in a moist crawlspace environment, and consequently indoor air quality within a home or building is negatively affected. Moreover, mold and moisture cause structural damage, especially to wood structures that can warp, weaken, and rot when exposed to mold and moisture.

The existing ventilators simply do not address these problems in a coordinate fashion. When the existing ventilators only address one or two of these problems, then typically the other problems are only made worse.

SUMMARY OF THE INVENTION

The present invention is a ventilating unit dimensioned, for example, to replace one concrete block in the wall of a crawlspace beneath a house. However, this ventilating unit can also be used in any kind of foundation whether or not the foundation consists of separate blocks or bricks, as opposed to a continuous material. During insertion of the unit, depressible pieces (e.g. spring clips) at the unit's periphery are depressed in order to hold the unit in place. However, the unit includes at least one manual handling feature to easily remove the ventilating unit, while overcoming the resistance of the depressible pieces. The ventilating unit is designed for removal in order to replace a filter that may itself be slidably removable from the unit. The ventilating unit also features an outwardly sloped bottom for drainage of liquids, for example due to condensation.

The filter is for filtering out 90% or more of the active outdoor mold spores. This filter will need to be replaced periodically, and therefore the spring clips are positioned near the front of the ventilating unit, so that the spring clips will not provide resistance after the ventilator unit is removed a small distance from its installed position.

The front of the ventilator faces away from the building when the ventilator is installed, and the rear of the ventilator faces into the building when the ventilator is installed. A securing device such as a set of brackets may be located at the rear of the ventilator, for securing the air filter to the rear of the ventilator. At least one of the manual handling features (e.g. a handle or hand grab), located at the front of the ventilator, is for removing the ventilator from between the concrete blocks. No tools are required to install or remove the vent, so a typical homeowner will be able to maintain a dry, clean crawlspace without difficulty. When installed, the front of the ventilator may advantageously have edges that are separated from the building foundation by a gasket of foam or rubber, in order to further protect the inside of the building from unwanted spores, moisture, insects, and the like.

DETAILED DESCRIPTION OF THE INVENTION

Figure 1:
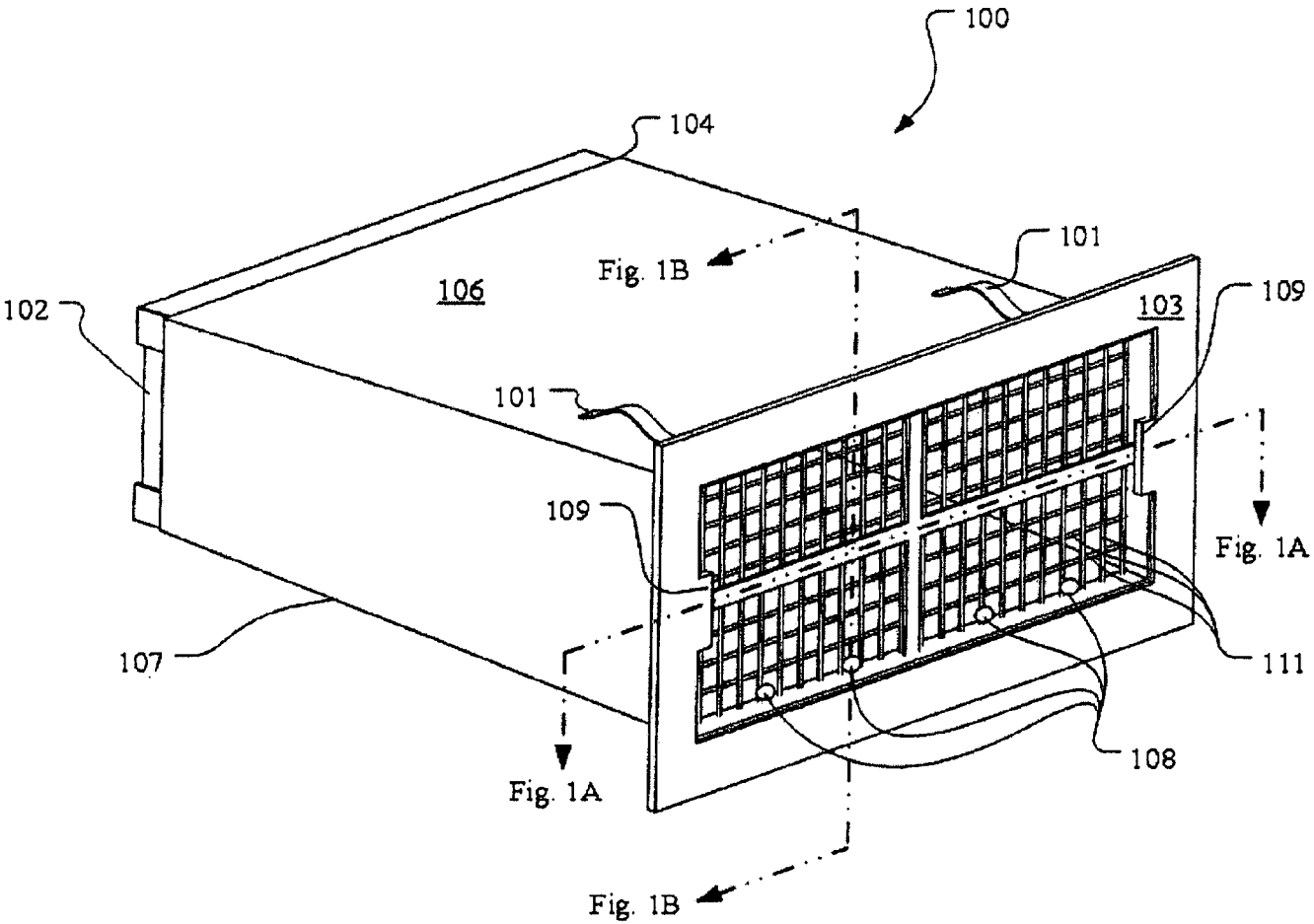
FIG. 1 is a perspective view of the removable ventilator including its front.

A best mode embodiment of the present invention can be best appreciated by reference to the accompanying drawings. As seen in FIG. 1, the ventilator 100 is preferably formed of hard plastic or rustproofed metal, and is equipped to hold a preferably replaceable air filter 102, the ventilator being dimensioned for placement between concrete blocks in a building foundation. The front 103 of the ventilator faces away from the building when the ventilator is installed. The rear 104 of the ventilator faces into the building when the ventilator is installed.

The ventilator includes a ceiling 106, and a floor 107. The ceiling is substantially flat and the floor is substantially flat also. The ceiling and the floor are at an angle to each other so that the floor and ceiling are farther apart at the front than at the rear, and thus the floor is sloped to allow moisture such as rain to exit through at least one drainage area, such as the drain holes 108 at the front 103 of the ventilator. The angle between the ceiling 106 and the floor 107 is between two and six degrees, with four degrees being a very suitable incline.

The ventilator 100 is also equipped with at least one manual handling feature or hand grab 109, located at the front 103, for removing the ventilator from between concrete blocks. The ventilator also comes with a grid or screening 111 at the front 103, in order to prevent the entry of sizable objects such as sticks, leaves, or animals into the ventilator. The ventilator 100 additionally includes spring clips 101, preferably mounted on top and bottom, for securely holding the ventilator between concrete blocks, although these spring clips can alternatively be positioned on the sides of the ventilator instead of the top and bottom.

In this embodiment, the front 103 is located at least nine inches from the back 104, and this unique depth (which can be up to fifteen inches from front to back) greatly improves air flow into the crawlspace due to vacuum pressures created naturally as a result of the recessed ventilator's structural depth. These vacuum pressures are due at least partly to the well-known Venturi effect, which arises from the combination of the continuity equation and the Bernoulli equation when, for an example, an incompressible fluid flows through a constriction in a pipe causing the pressure to drop in the pipe. The present ventilator thus acts, in effect, like a pipe. A further advantage of this unique depth is that it further isolates the filter 102 from the outside environment including rain, thus increasing the lifespan and effectiveness of the filter.

Figure 1A:
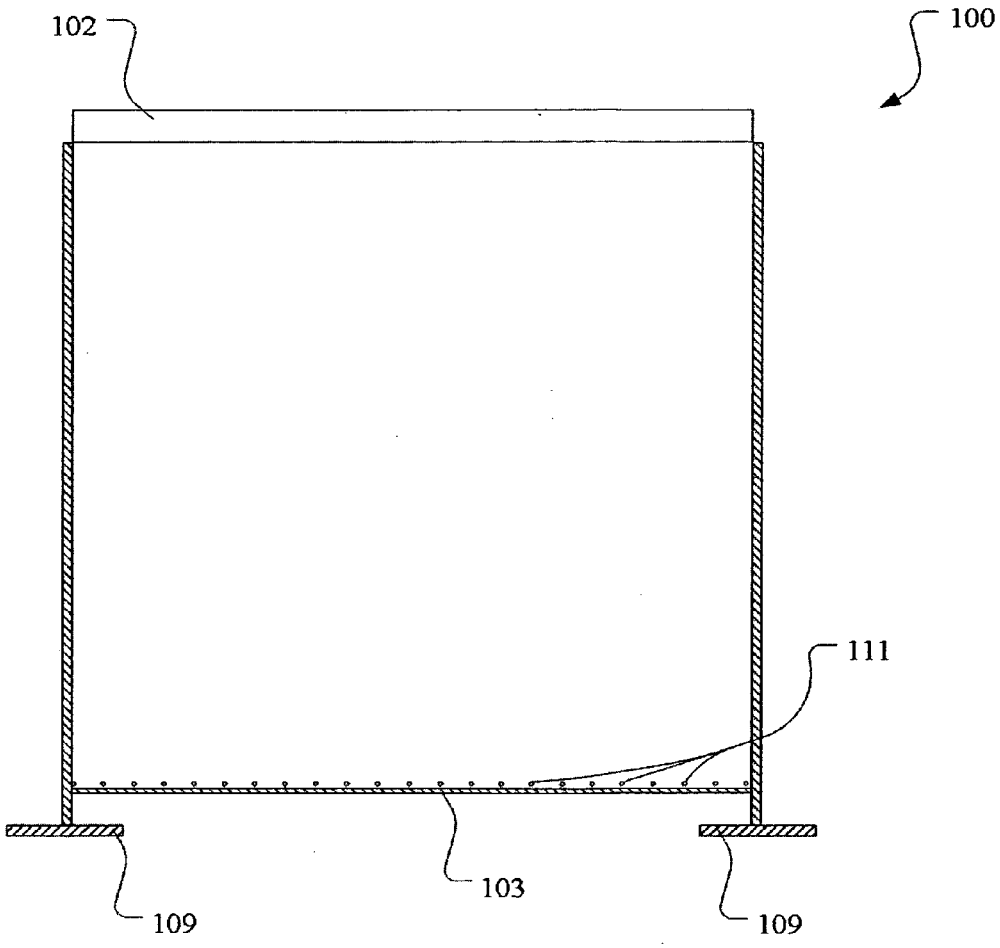
FIG. 1A is a horizontal cross-sectional top view as indicated by the line 1A in FIG. 1.

Referring now to FIG. 1A, this is a horizontal cross-sectional top view of the ventilator, as indicated by the line 1A in FIG. 1. The air filter 102 is in proper position for operation of the ventilator 100. The grid or mesh screen 111 at the front 103 of the ventilator will screen out large matter, whereas the filter 102 will screen out small matter such as mold spores and pollen. This device thus provides a double barrier to protect the basement or crawlspace from unwanted outdoor matter. Additionally, the ventilator may include a mechanism for blocking incoming air when, for example, the outdoor air temperature falls below a threshold; this blocking may be accomplished manually, or it may be automatic. To the right and to the left of the grid or mesh screen 111, there are hand grabs 109, and the one on the left is enlarged in FIG. 1A to show the hand grab 109 more clearly, formed as a flange protruding inwardly, spaced forwardly in front of grid or mesh screen 111. These hand grabs will come forwardly when impelled by human fingers hooked behind them, in order to pull the ventilator out from between the concrete blocks. These particular handle-free, ergonomically designed hand "grabs" allow the user to remove the ventilator without tools and without compromising airflow therethrough.

The air filter 102 is structured to screen out at least most particles greater than five microns in size. The most common size for mold spores and pollen is between three and ten microns, and these sizes are classified as "E3." The American Society of Heating, Refrigerating and Air Conditioning Engineers (ASHRAE) has organized particle sizes into three simplified efficiency ranges—E1, E2, and E3. The first group, E1, is best addressed by what we currently refer to as high-efficiency filters. These filters would be used to target small particles of 0.3 to 1.0 micron. To target medium particles of 1.0 to 3.0 microns in size, one would choose a "medium efficiency" filter with optimum efficiencies in the E2 range. And for large (3.0 to 10.0 micron) particles, a filter with removal efficiencies in the E3 range would be the appropriate choice, as it is here.

Many organisms, from bacterial colonies to redwood forests, grow from spores. Most spores begin in the 0.5 to 2 micron size range. Typically spores are not round balls with smooth surfaces; more common are fuzzy seeds with a length greater then their diameter. The structure of spores makes them likely to agglomerate or join together into larger particles, and thus an E3 filter is adequate to screen out the vast majority of spores.

Figure 1B:
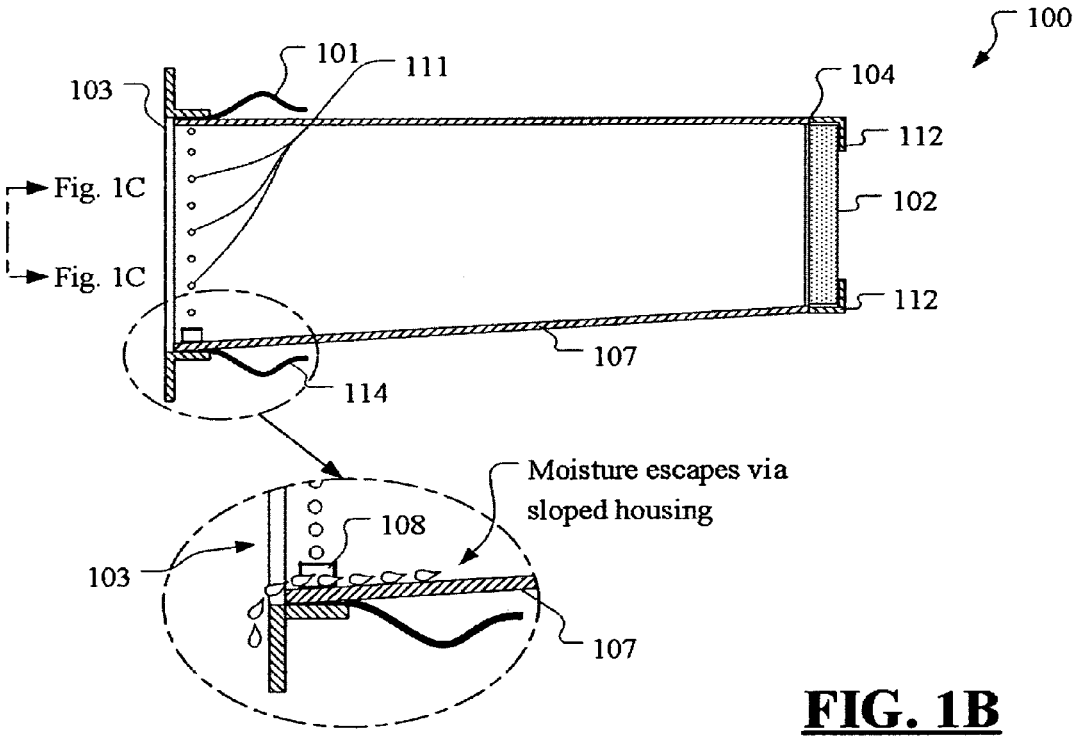
FIG. 1B is a vertical cross-sectional view as indicated by the line 1B in FIG. 1.
Figure 1C:
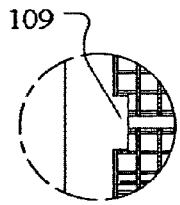

Turning now to FIG. 1B, one of the drain holes 108 is enlarged for greater clarity, and the progression of water droplets along the sloped floor 107 of the ventilator is easily seen. The ventilator 100 also includes a securing device such as brackets 112, for holding the filter 102 while still allowing the filter to slide sideways if it is replaceable. In other words, the air filter—if replaceable—is slidably releasable along a plane parallel to the back 104 of the ventilator, without any tools.

The ventilator 100 further includes an upper set of spring clips 101 which may consist of only one spring clip, and a lower set of spring clips 114 which likewise may consist of one or more spring clips. As mentioned, these clips can alternatively or additionally be placed on the sides of the ventilator, as long as at least two exterior surfaces of the ventilator are equipped with depressible pieces such as the spring clips 114, for securing the ventilator between concrete blocks. Each of the depressible pieces—be it a leaf spring or spring clip 104 or some other springy device—has only one end attached to the exterior. Each of the depressible pieces is resilient, so that it returns to its undepressed configuration when the ventilator is removed from between the concrete blocks.

As seen in FIG. 1B, each of the depressible pieces, in either its depressed or released configuration, is entirely located nearer to the front 103 of the ventilator than the rear 104. A major advantage of having the spring clips near the front 103 is that someone pulling the ventilator out or pushing it in will encounter resistance from the clips for only a short while, whereas if the clips were positioned near the rear 104 they would have to scrape along the concrete blocks for almost the entire withdrawal or insertion of the ventilator. Likewise, each of the spring clips 114, in its depressed configuration, may advantageously be entirely located nearer to the front 103 of the ventilator than any point halfway between the front 103 and the back 104 (i.e. the spring clips are located less than a quarter of the way from the front to the back of the ventilator).

Figure 2:
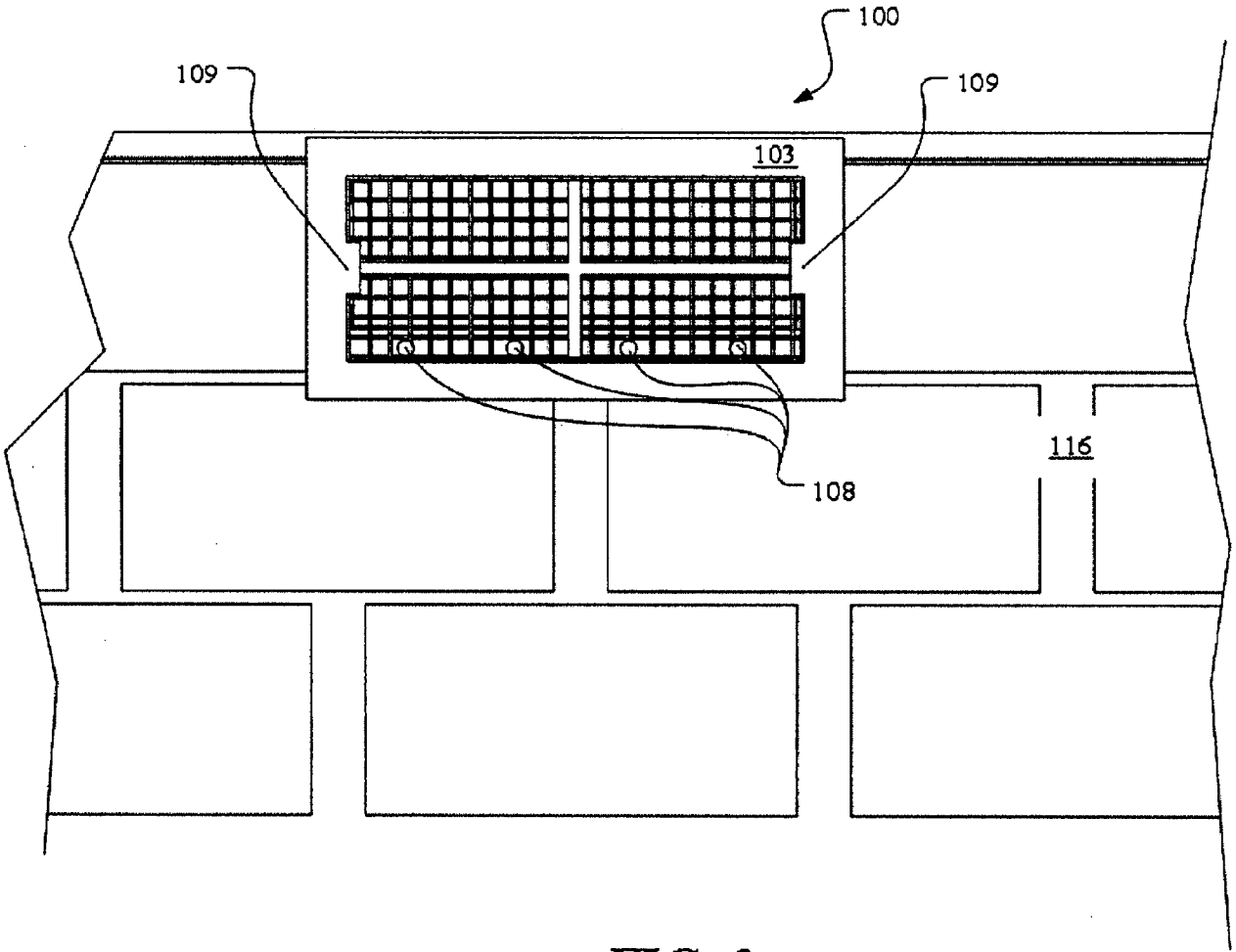
FIG. 2 is a front view of the removable ventilator.

FIG. 2 is a front view, showing the front 103 of the ventilator, substantially flush with the outer wall 116 of a building foundation. The hand grabs 109 facilitate easy removal of the apparatus from a cavity in the foundation. The drain holes 108 facilitate water drainage due to condensation, or due to rain that falls from the sky at an angle into the ventilator 100.

Figure 3:
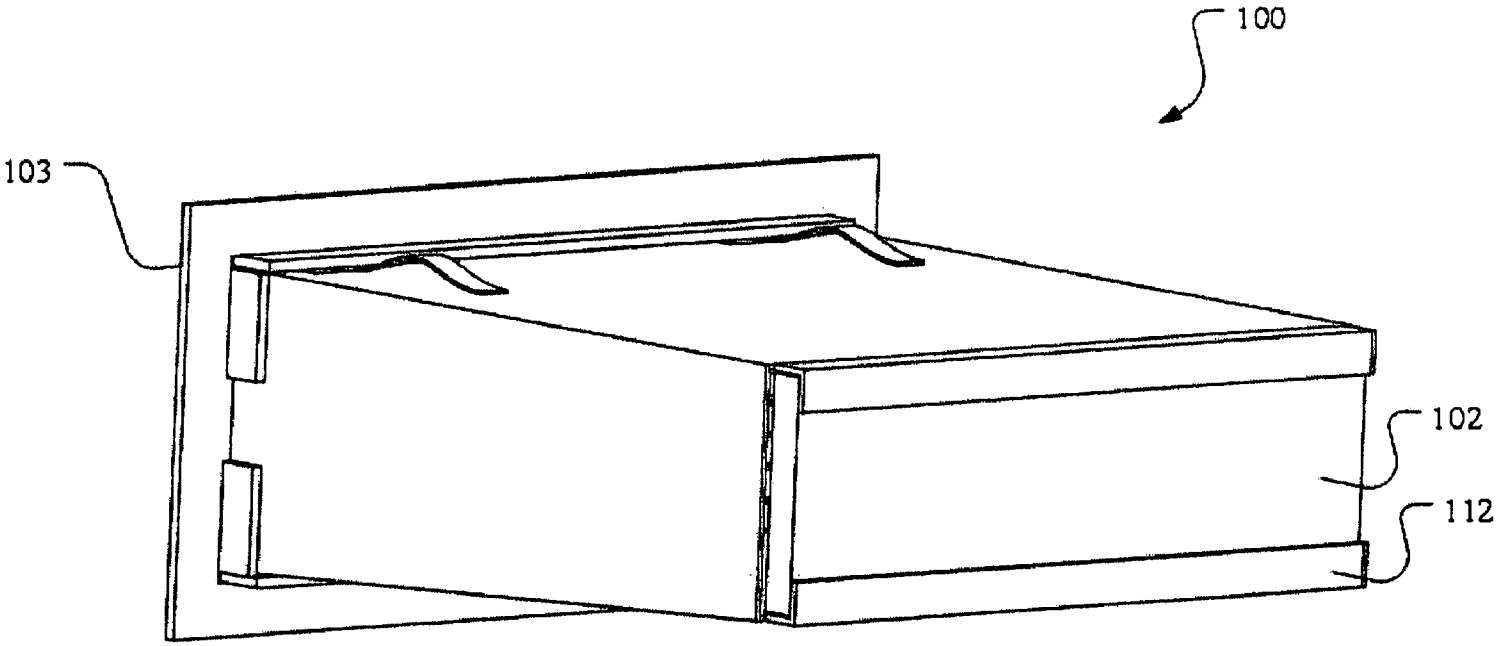
FIG. 3 is a rear perspective view of the removable ventilator including a filter in alignment, installed in its operating position.
Figure 4:
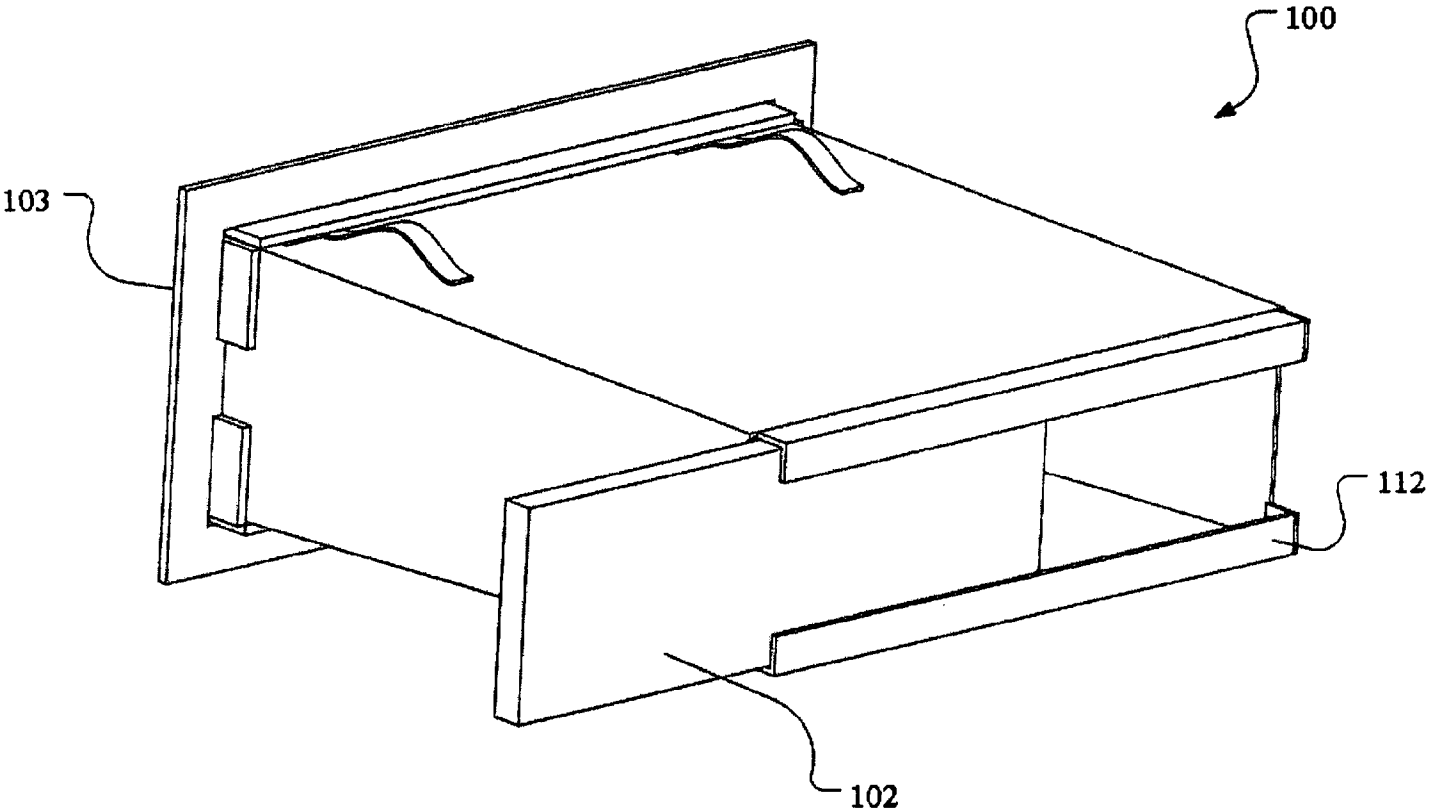
FIG. 4 is a rear perspective view of the removable ventilator including a filter partially slid out of alignment.
Figure 5:
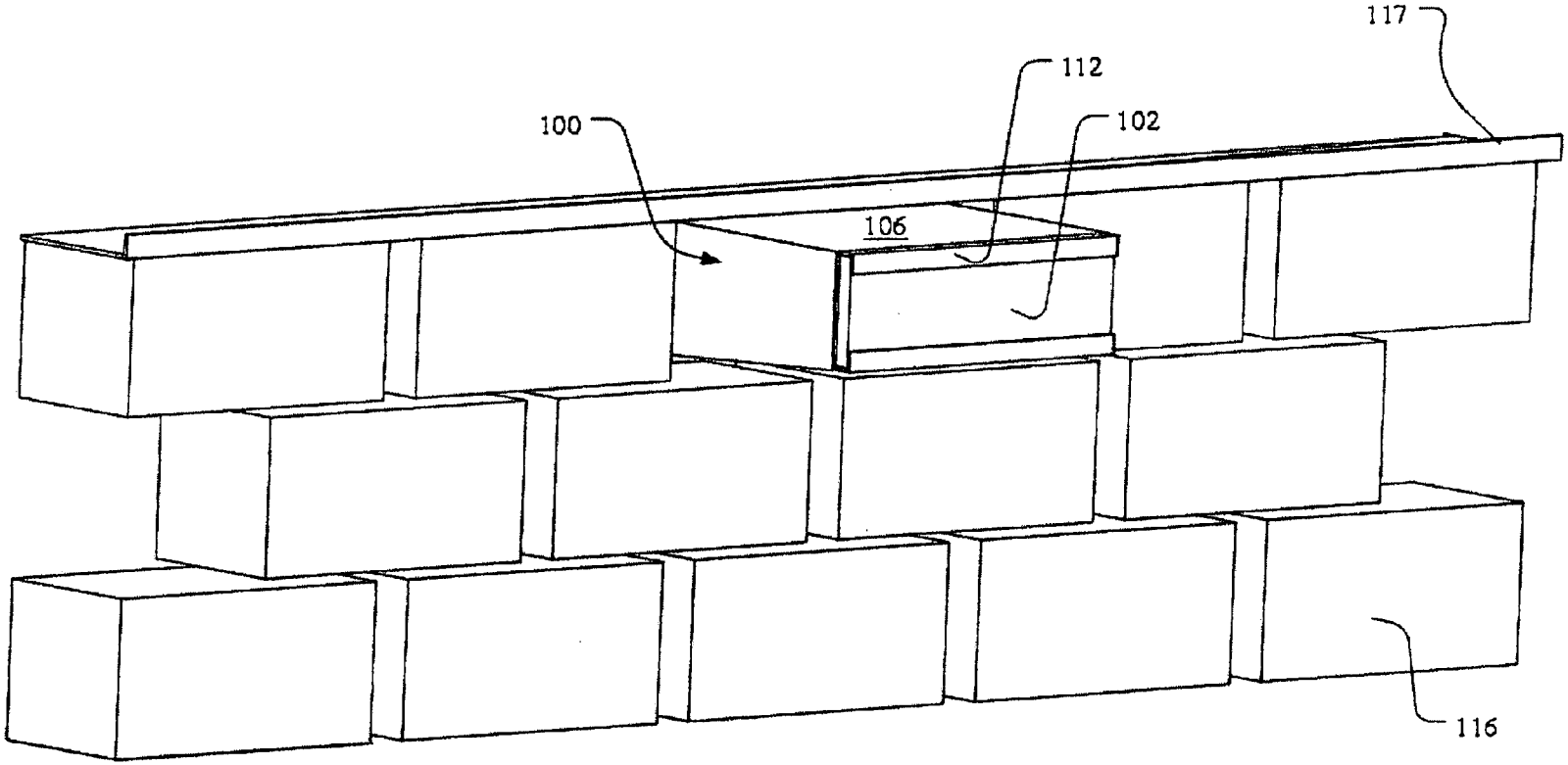
FIG. 5 is a rear perspective view of the removable ventilator installed.

FIG. 3 shows more fully how the filter is mounted and secured, by brackets 112 that extend the entire width of the ventilator, and FIG. 4 shows the filter 102 being removed or inserted. FIG. 5 is a view of the ventilator 100 from inside the basement or crawlspace, with the ceiling 106 of the ventilator in a substantially horizontal position, contacting a sill plate 117. Thus, although the ventilator is located between cement or concrete blocks, it need not be totally surrounded by those blocks. The air filter is releasable from the brackets 112, both in the crawlspace and outside the crawlspace, so that the user has an option whether to perform maintenance from outside or inside the perimeter of the building.

Figure 6:
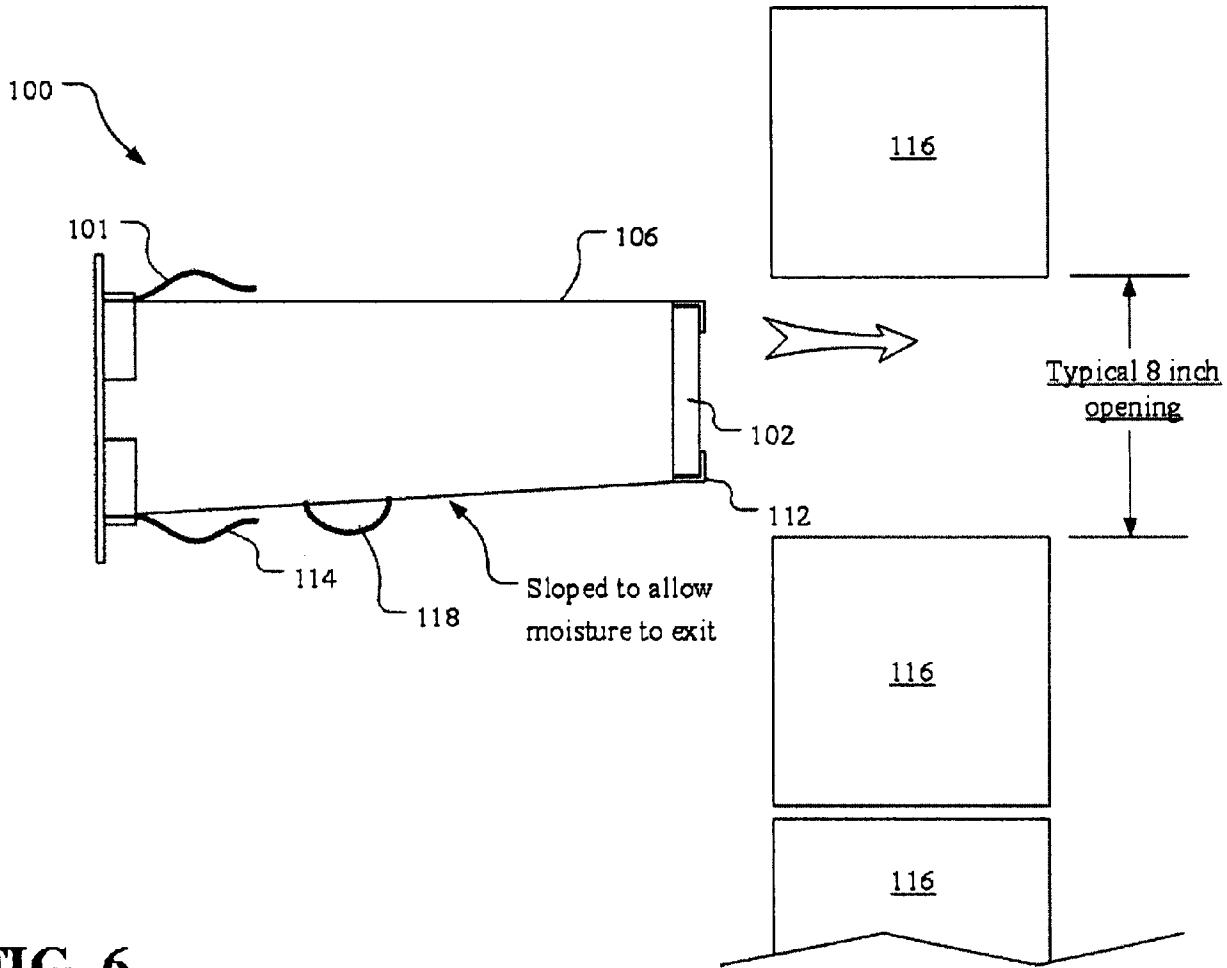
FIG. 6 is a side view of the removable ventilator before insertion between concrete blocks.
Figure 7:
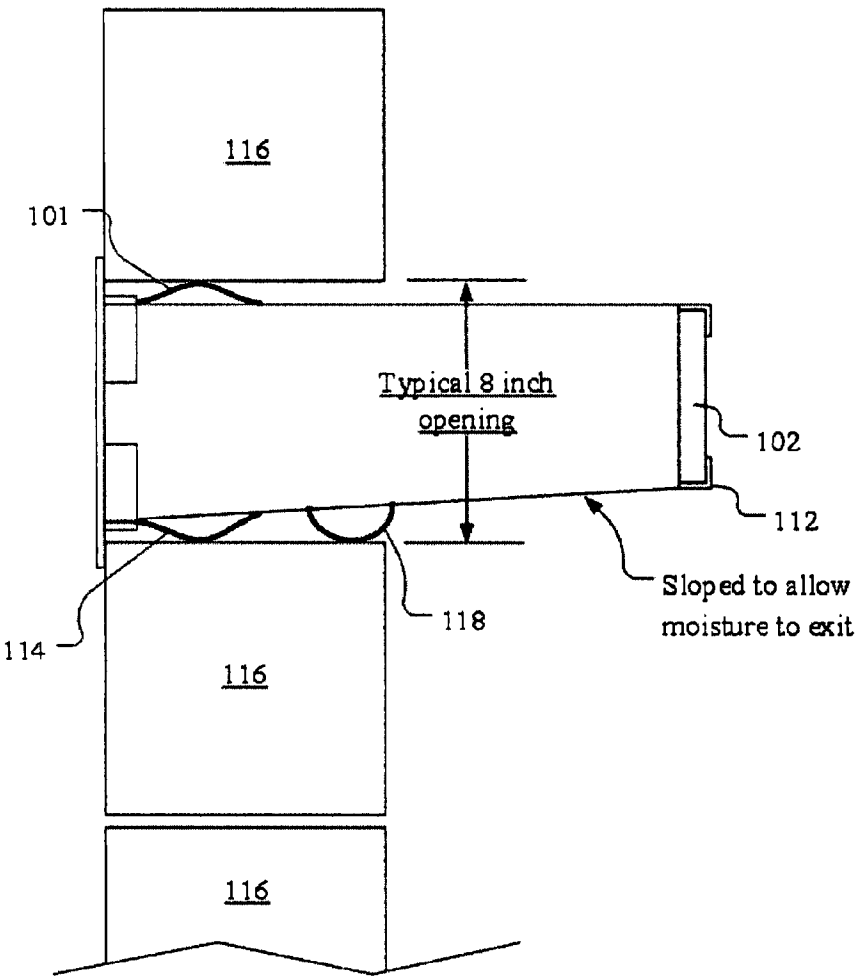
FIG. 7 is a side view of the removable ventilator fully inserted between concrete blocks.

Turning now to FIG. 6, we again see the ventilator 100, as it is about to be inserted into the concrete wall 116. In addition to the elements of the ventilator already discussed, the ventilator may also include an optional bottom skid element 118 protruding downward from floor 107, which helps to maintain the ceiling 106 in a horizontal mode while the ventilator is installed. This bottom element 118 is not absolutely essential for this purpose, because the ventilator may be held very securely by the spring clips 101, but nevertheless the bottom element may sometimes be helpful. This bottom element 118 may simply comprise two partial spheres of hard plastic extending convexly downward. In any event, the bottom element has its lowest point at a distance from the ceiling that is substantially equal to the greatest distance between the ceiling 106 and the floor 107. FIG. 7 is essentially the same as FIG. 6, except that it shows the ventilator housing fully inserted between the concrete blocks.

Various changes may be made in the above illustrative embodiments without departing from the scope of the invention, as will be understood by those skilled in the art. It is intended that all matter contained in the above description or shown in the accompanying drawings shall be interpreted as illustrative and not in a limiting sense. The invention disclosed herein can be implemented by a variety of combinations of material, and those skilled in the art will understand that those implementations are derivable from the invention as disclosed herein.

What is claimed is:

1. A ventilator equipped to hold an air filter, the ventilator being shaped for placement in a building foundation, the ventilator comprising:

a front of the ventilator, for facing away from the building toward the outdoors when the ventilator is installed;

a rear of the ventilator, for facing into the building when the ventilator is installed;

a ceiling of the ventilator;

a floor of the ventilator;

at least one securing device located at the rear, for securing the air filter spanning the rear; and at least one manual handling feature located at the front, for removing the ventilator from the building foundation, wherein the front comprises a perforated grid surface and the rear is open, wherein the ceiling is substantially flat and the floor is substantially flat, wherein the ceiling and the floor are at an angle with each other so that the floor and ceiling are farther apart at the front than at the rear, wherein the front is equipped with at least one drainage area for draining liquid from the floor of the ventilator, wherein the floor is between the rear and the front comprising the grid surface, and wherein the front comprising the grid surface is flat and configured for placement substantially flush with the building foundation.

2. The ventilator of claim 1, further comprising at least one protruding bottom element having a lowest point at a distance from the ceiling that is substantially equal to the greatest distance between the ceiling and the floor.

3. The ventilator of claim 1, further comprising the air filter, wherein the air filter is structured to screen out at least most airborne particles greater than five microns in size, and wherein the air filter is releasable from the at least one securing device, both in a crawlspace and outside the crawlspace.

4. The ventilator of claim 3, wherein the air filter is slidably releasable along a plane parallel to the back of the ventilator.

5. The ventilator of claim 1, wherein the ventilator has at least two opposite exterior surfaces equipped with oppositely protruding depressible pieces, for securing the ventilator in place, wherein each of the depressible pieces, in its depressed configuration, is entirely located nearer to the front of the ventilator than to the rear.

6. The ventilator of claim 5, wherein each of the depressible pieces is a leaf spring or spring clip having only one end anchored to the exterior surface, and wherein the at least two exterior surfaces comprise opposite sides of the ventilator.

7. The ventilator of claim 5, wherein each of the depressible pieces, in its depressed configuration, is entirely located nearer to the front of the ventilator than to any point halfway between the front and the back.

8. The ventilator of claim 1, wherein the front is located at least five inches from the back.

9. The ventilator of claim 8, wherein the front is located at least nine inches from the back.

10. The ventilator of claim 1, wherein the angle is between two and six degrees.

11. The ventilator of claim 1, wherein each of the at least one manual handling feature is formed as a flange spaced apart from a solid or perforated surface of the front of the ventilator.

12. The ventilator of claim 11, wherein the flange is positioned parallel to said surface, and wherein the flange protrudes inwardly, and is spaced forwardly from said surface.

13. The ventilator of claim 12, wherein the at least one manual handling feature comprises two manual handling features protruding inwardly toward each other.

14. The ventilator of claim 1, further comprising a perforated grid surface at the front of the ventilator, and a gasket around the front of the ventilator.

* * * * *